US008102221B2

(12) United States Patent
Ryou et al.

(10) Patent No.: US 8,102,221 B2
(45) Date of Patent: Jan. 24, 2012

(54) RF SWITCH

(75) Inventors: Byung Hoon Ryou, Seoul (KR); Won Mo Sung, Siheung-si (KR); Dong Ryul Shin, Daegu (KR); Jeong Pyo Kim, Seoul (KR); Chang Hyun Park, Incheon (KR)

(73) Assignee: EMW Co., Ltd., Incheon (KR)

( * ) Notice: Subject to any disclaimer, the term of this patent is extended or adjusted under 35 U.S.C. 154(b) by 158 days.

(21) Appl. No.: 12/525,671

(22) PCT Filed: Feb. 4, 2008

(86) PCT No.: PCT/KR2008/000650

§ 371 (c)(1),
(2), (4) Date: Aug. 3, 2009

(87) PCT Pub. No.: WO2008/096990

PCT Pub. Date: Aug. 14, 2008

(65) Prior Publication Data

US 2010/0019861 A1 Jan. 28, 2010

(30) Foreign Application Priority Data

Feb. 5, 2007 (KR) ..... 10-2007-0011341

(51) Int. Cl.
*H01P 1/15* (2006.01)
*H01P 1/18* (2006.01)

(52) U.S. Cl. ..... 333/103; 333/104; 333/164

(58) Field of Classification Search ..... 333/101, 333/103, 104, 156, 164
See application file for complete search history.

(56) References Cited

U.S. PATENT DOCUMENTS

| | | | | |
|---|---|---|---|---|
| 5,877,659 | A * | 3/1999 | Knowles et al. | 333/164 |
| 6,542,051 | B1 | 4/2003 | Nakada | |
| 7,839,236 | B2 * | 11/2010 | Dupuy et al. | 333/136 |
| 2004/0021526 | A1 | 2/2004 | Jeong et al. | |
| 2005/0190018 | A1 | 9/2005 | Kawai et al. | |

OTHER PUBLICATIONS

PCT International Search Report for PCT Counterpart Application No. PCT/KR2008/000650 containing Communication relating to the Results of the Partial International Search Report, 2 pgs., (May 22, 2008).

(Continued)

*Primary Examiner* — Dean Takaoka
(74) *Attorney, Agent, or Firm* — Blakely, Sokoloff, Taylor & Zafman LLP.

(57) ABSTRACT

The present invention provides an RF switch, including a diode adapted to operate as a switch when a control current is applied thereto, a first CRLH transmission line of a Φ degree phase, which provides one signal transfer path from a terminal 1 to a terminal 2 when the diode is shorted due to application of a control current, and a second CRLH transmission line of a Φ-180 degree phase, which has a 180 degree phase difference from that of the first CRLH transmission line and provides the other signal transfer path from the terminal 1 to the terminal 2. The present invention provides an RF switch having a broad-band characteristic by employing a CRLH transmission line. More specifically, the present invention provides a ring-shaped RF switch, which has a broad-band characteristic and can also be miniaturized at a low frequency band, by employing a CRLH transmission line having a 180 degree phase difference in a broad band.

6 Claims, 5 Drawing Sheets

OTHER PUBLICATIONS

Caloz, C. et al., "Arbitrary Dual-Band Components Using Composite Right/Left-Handed Transmission Lines", IEEE Transactions on Microwave Theory and Techniques, IEEE Service Center, Piscataway, NJ, US, vol. 52, No. 4, Apr. 1, 2004, pp. 1142-1149, XP011110491, ISSN: 0018-9480, DOI: DOI:10.1109/TMTT.2004.823579 abstract.

Extended European Search Report pertaining to corresponding European application (EP 08712302.2) dated Mar. 23, 2011, total 6 pages.

Nguyen, H. V., et al., "Metamaterial-Based Dual-Band Six-Port Front-End for Direct Digital QPSK Transceiver (Invited Paper)", Electrotechnical Conference, 2006. MELECON 2006. IEEE Mediterranean Benalmadena, Spain May 16-19, 2006, Piscataway, NJ, USA, IEEE, May 16, 2006, pp. 363-366, XP010927769, DOI: DOI: 10.1109/MELCON.2006.1653114 ISBN: 978-1-4244-0087-4 * Section III. CRLH TL Dual band components *; p. 364-p. 365.

* cited by examiner

[Fig. 1]
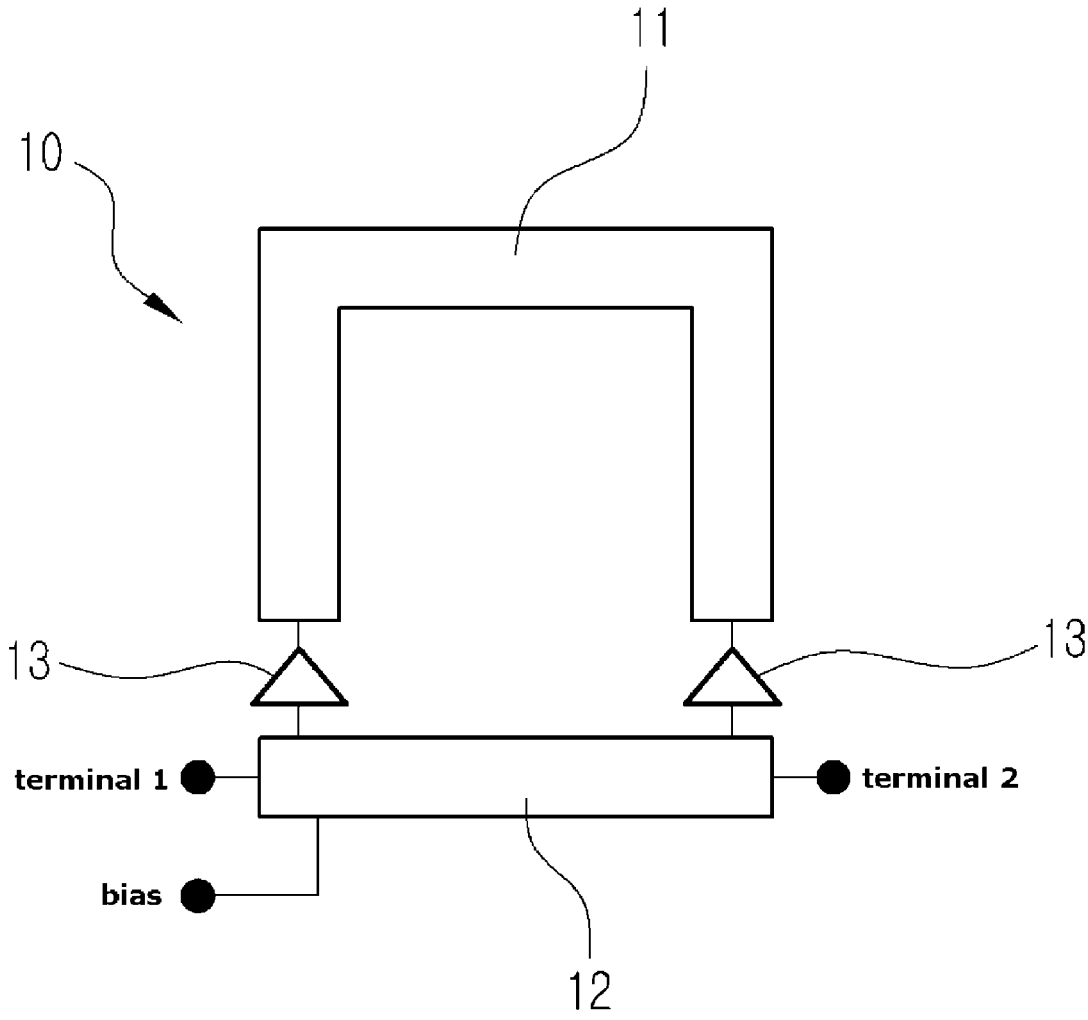

[Fig. 2]
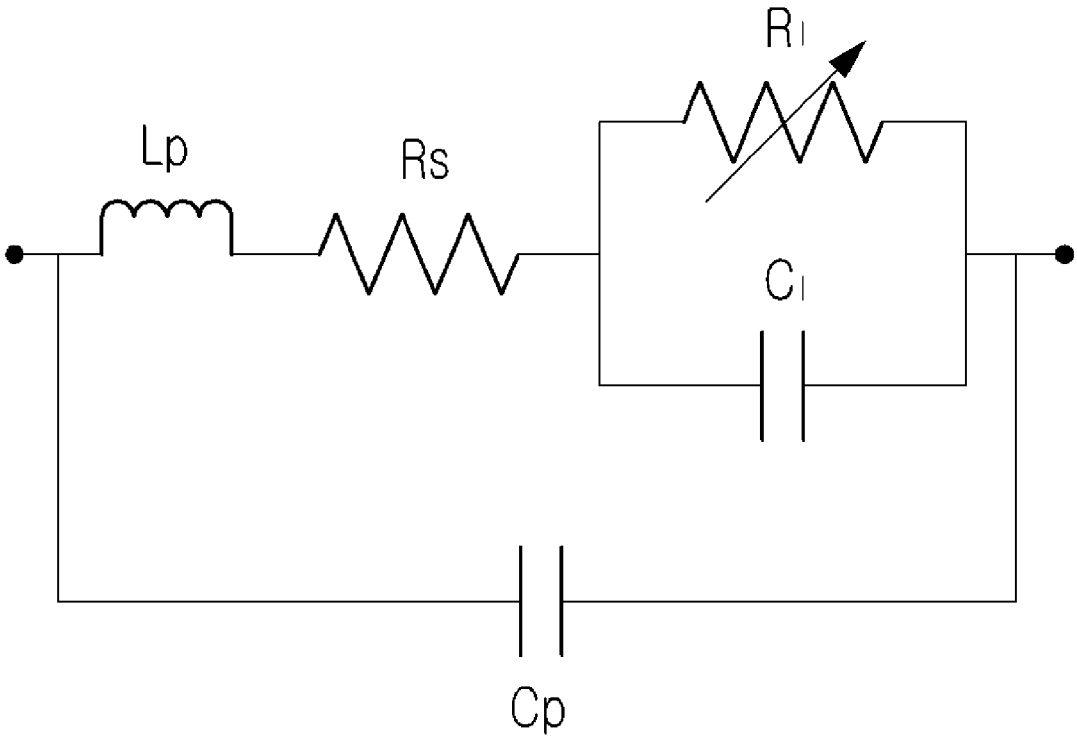

[Fig. 3]
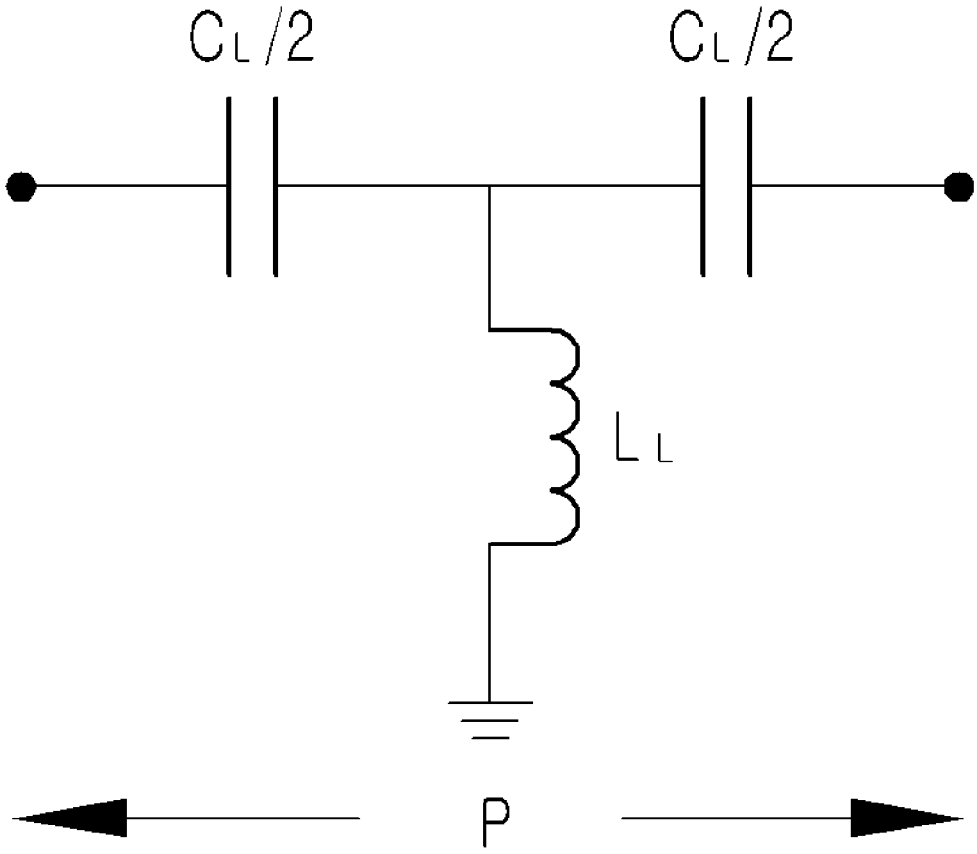

[Fig. 4]
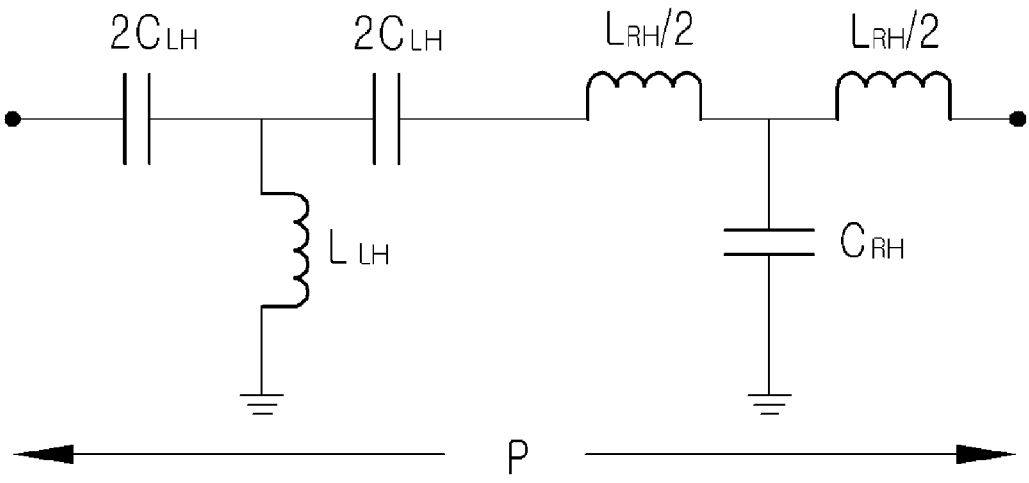
[Fig. 5]
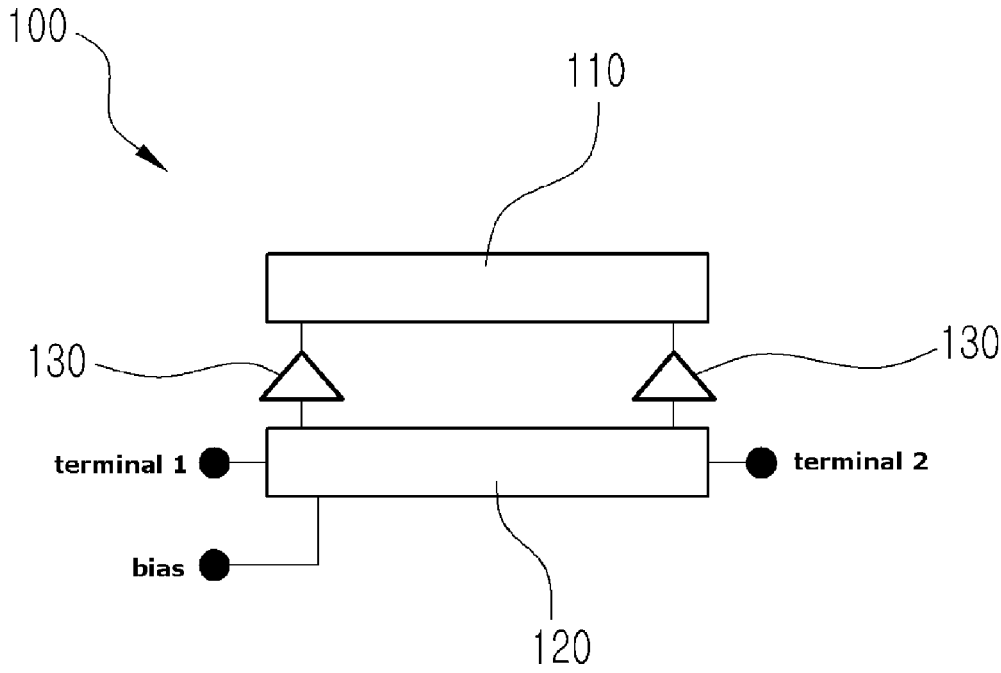

[Fig. 6]
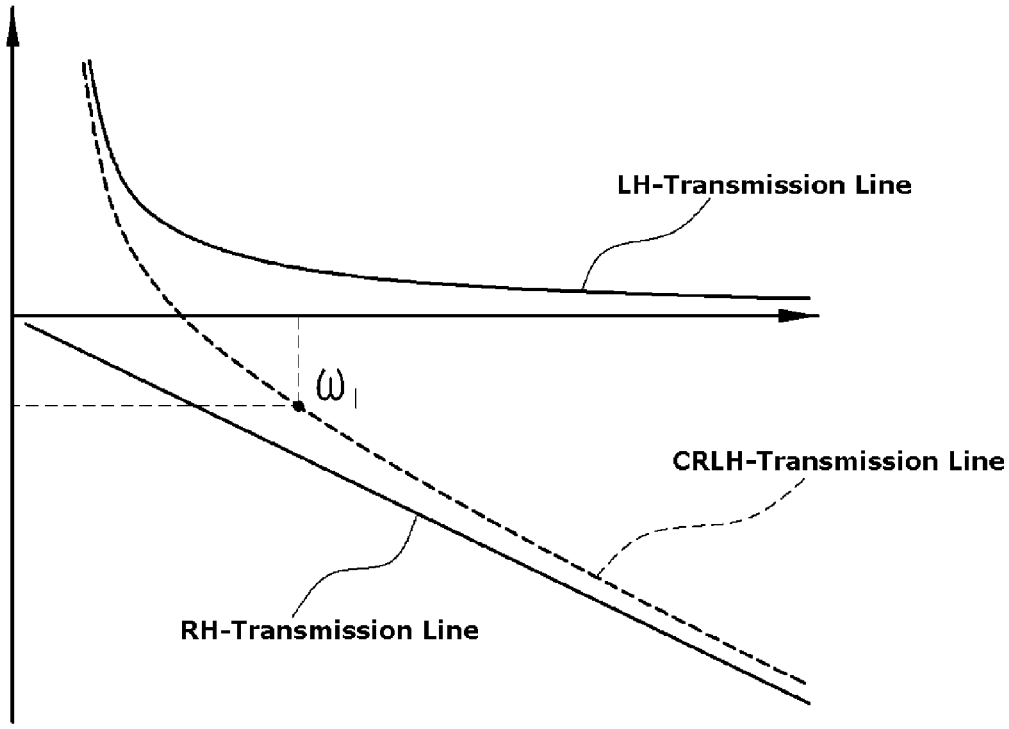
[Fig. 7]
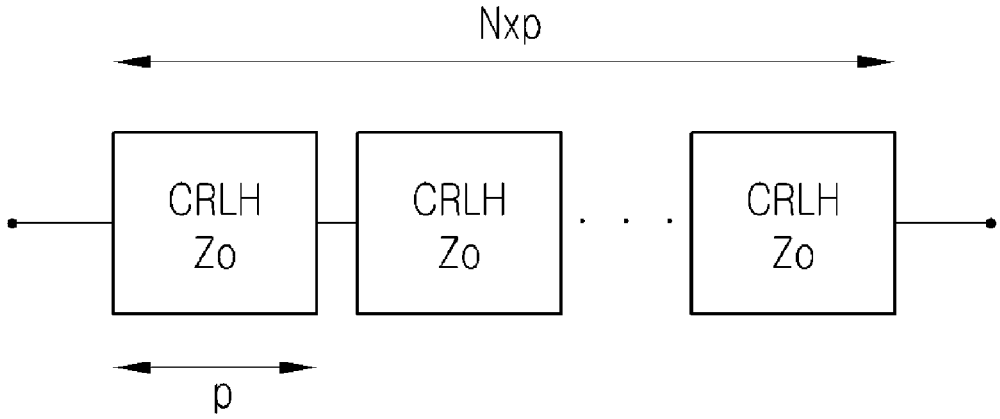

RF SWITCH

CROSS-REFERENCE TO RELATED APPLICATIONS

This patent application is a U.S. National Phase application under 35 U.S.C. 371 of International Application No. PCT/KR2008/000650, filed on Feb. 4, 2008, entitled RF SWITCH, which claims priority to Korean patent application number 10-2007-0011341, filed Feb. 5, 2007.

TECHNICAL FIELD

The present invention relates to a high-power radio frequency (RF) switch, and more particularly, to a high-power RF switch that can be used in a broad band by employing a composite right/left-handed (CRLH) transmission line in which a right-handed (RH) characteristic and a left-handed (LH) characteristic are combined.

BACKGROUND ART

In general, in a transmission/reception system using, in particular, transmission/reception as one antenna, in TDD (Time Division Duplexing) communications having the same transmission/reception frequency such as Wibro or RF, it is indispensably necessary to design a circuit unit with a high degree of isolation between transmit and receiving parts so as to prevent the receiving part from being broken due to a high-power transmission signal. This circuit unit is generally configured using a circulator or an RF switch. The circulator is advantageous in a high-power, but is disadvantageous in that it has a low degree of isolation and is bulky and expensive. An integrated chip type RF switch is advantageous in that it has a wide bandwidth and a small volume, but is disadvantageous in that it has a low output and a low degree of isolation. A ring type RF switch is advantageous in that 1) it can be fabricated easily and has 2) a high-power, 3) a high degree of isolation, and 4) a low insertion loss through attenuation by a 180 degree phase difference, but is disadvantageous in that it has a narrow bandwidth and is difficult to miniaturize in a low frequency band since it has a size proportional to a wavelength length of a design frequency.

The conventional technology and the problems of the conventional technology are described below with reference to the drawings.

FIG. 1 is a view illustrating a general ring switch.

Referring to FIG. 1, a general ring switch 10 includes a 3λ/4 RH transmission line (−270 degrees) 11, a λ/4 transmission line (−90 degrees) 12 and PIN diodes 13. The PIN diode 13 is an element, which has an excellent linearity and very small distortion and can be switched at high speed, and is equalized as shown in FIG. 2. In FIG. 2, $L_p$ and $C_p$ denote the inductance and capacitance by a package, $C_i$ denotes intrinsic layer capacitance, $R_s$ denotes a serial resistor, and $R_i$ denotes a variable resistor by a control current.

When a control current is applied to the ring switch 10, the PIN diodes 13 become short. Signals applied through a terminal 1 have a 180 degree phase difference through the 3λ/4 RH transmission line 11 and the λ/4 transmission line (−90 degrees) 12, so that they are attenuated in a terminal 2. Further, a signal reflected from the terminal 2 due to mismatching is also attenuated in the terminal 1. Thus, the ring switch 10 operates as a switch when the control current is applied thereto.

The ring switch employing this RH transmission line and the PIN diode can be fabricated and designed easily, but is problematic in a narrow bandwidth.

To solve the problem, active research has recently been done into MM (Meta-material) having a negative dielectric constant and conductivity and microwave elements employing the MM have been developed. Research on MM or LHM (Left-Handed Material) was first begun by Velselago who was a Russian physicist in 1967. The MM or LHM has a negative dielectric constant and transmittance and therefore shows peculiar electromagnetic characteristics, such as phase and group velocity with opposite directions and a negative reflection coefficient. The electromagnetic characteristics of the LHM can be implemented through an artificial structure and a structure of the LHM is composed of a unit cell. The cell must have an electrical size, which is ¼ or less of a guided wavelength. This is called an effective-homogeneity condition.

An application of the LHM to microwave elements is implemented through a combination of serial capacitance and parallel inductance when a general transmission line is equalized based on a lossless transmission line mode. However, an ideal transmission line of the LHM cannot be implemented due to the loss of the current and voltage according to electric waves, and therefore can be equalized as a CRLH transmission line in which the RH characteristic is incorporated. If this CRLH transmission line is applied to microwave elements, it can be applied to broad-band, miniaturized and dual band designs.

SUMMARY

Accordingly, the present invention has been made in view of the above problems occurring in the prior art, and an object of the present invention is to provide an RF switch with a broad-band characteristic by employing a CRLH transmission line.

More specifically, an object of the present invention is to provide an RF switch of a ring shape, which has a broad-band characteristic and can be minimized at a low frequency band by employing a CRLH transmission line with a phase difference of 180 degrees in a broad band.

More specifically, an object of the present invention is to provide an RF switch of a ring shape by employing a CRLH transmission line, which can be designed to have phases of specific Φ degrees and (Φ-180) degrees (that is, a 180 degree phase difference as a broad band) by a designer instead of a RH transmission line having −90 degree and −270 degree phases of a ring resonator.

To achieve the above objects, the present invention provides an RF switch, including a diode adapted to operate as a switch when a control current is applied thereto, a first CRLH transmission line of a Φ degree phase, which provides one signal transfer path from a terminal 1 to a terminal 2 when the diode is shorted due to application of a control current, and a second CRLH transmission line of a Φ-180 degree phase, which has a 180 degree phase difference from that of the first CRLH transmission line and provides the other signal transfer path from the terminal 1 to the terminal 2.

Preferably, the Φ degree of the first CRLH transmission line may be adjusted by controlling capacitance and inductance values included in a transmission line.

Further, the first CRLH transmission line and the second CRLH transmission line may be composed of N cells having the same electromagnetic characteristic with a CRLH transmission line characteristic.

More preferably, each of the cells may have an electrical length p, which is smaller than ¼ of a wavelength of a designed center frequency.

Further, the first CRLH transmission line and the second CRLH transmission line composed of the N cells may satisfy the following Equations:

$$\phi_{CRLH1} = N \cdot \left\{ \omega\sqrt{L_{RH1}C_{RH1}} \cdot d + \frac{-1}{\omega\sqrt{L_{LH1}C_{LH1}}} \right\} = N \cdot (\phi_{RH1}(\omega) + \phi_{LH1}(\omega))$$

and $$Z_0 = \sqrt{\frac{L_{RH1}}{C_{RH1}}} = \sqrt{\frac{L_{LH1}}{C_{LH1}}}$$

Meanwhile, the diode may include a PIN diode, which has an excellent linearity and very small distortion and can be switched at high speed.

Furthermore, the first CRLH transmission line and the second CRLH transmission line may satisfy the following Equations in order to satisfy a constant phase difference:

$$\phi_{CRLH1} = \phi_{CRLH2} + \pi,$$

$$\frac{\Delta\phi_{CRLH1}}{\Delta\omega} = \frac{\Delta\phi_{CRLH2}}{\Delta\omega}, \text{ and}$$

$$Z_0 = \sqrt{\frac{L_{RH}}{C_{RH}}} = \sqrt{\frac{L_{LH}}{C_{LH}}}.$$

Further, the present invention provides a radio terminal device including the RF switch 7.

The present invention provides an RF switch with a broad-band characteristic by employing a CRLH transmission line. More specifically, the present invention provides an RF switch of a ring shape, which has a broad-band characteristic and can be minimized at a low frequency band by employing a CRLH transmission line having a phase difference of 180 degrees in a broad band.

More specifically, the present invention provides an RF switch of a ring shape by employing a CRLH transmission line, which can be designed to have phases of specific Φ degrees and (Φ-180) degrees (that is, a 180 degree phase difference as a broad band) by a designer instead of a RH transmission line having −90 degree and −270 degree phases of a ring resonator.

BRIEF DESCRIPTION OF THE DRAWINGS

Further objects and advantages of the invention can be more fully understood from the following detailed description taken in conjunction with the accompanying drawings in which:

FIG. 1 is a view illustrating a general ring switch;

FIG. 2 is an equalized view of a PIN diode;

FIG. 3 is a view showing a LH transmission line of the present invention;

FIG. 4 is a view showing a unit cell of a CRLH transmission line in accordance with the present invention;

FIG. 5 is a view showing a ring switch in accordance with an embodiment of the present invention;

FIG. 6 is a view illustrating a change in the phase depending on a frequency, which is changed depending on a design of the RH transmission line and the LH transmission line in accordance with the present invention; and FIG. 7 is a view showing a transmission line composed of N CRLH cells in accordance with the present invention.

DETAILED DESCRIPTION

To fully understand the present invention, the advantages in the operation of the present invention, and the objects accomplished by the implementations of the present invention, reference should be made to the accompanying drawings illustrating preferred embodiments of the present invention and the contents described in the accompanying drawings.

The present invention will now be described in detail in connection with the preferred embodiments of the present invention with reference to the accompanying drawings. The same reference numbers will be used throughout the drawings to refer to the same or like parts.

FIG. 3 is a view showing a LH transmission line of the present invention.

When there is no loss under the effective-homogeneity condition, a unit cell of a MM transmission line is equalized and modeled into a serial C and a parallel L, as shown in FIG. 3. A LH transmission line has electromagnetic characteristics (having opposite directions in the phase and group velocity and a negative reflection coefficient), which are hard to obtain in the nature system, and can be implemented only through a specific electromagnetic structure. The propagation constant, characteristic impedance, phase constant and group velocity of the LH transmission line can be expressed by the following Equations 1 to 4:

$$\beta = -\frac{1}{2\pi f\sqrt{L_L C_L}} \quad \text{[Equation 1]}$$

$$Z_C = \sqrt{\frac{L_L}{C_L}} \quad \text{[Equation 2]}$$

$$v_P = -w^2\sqrt{L_L C_L} \quad \text{[Equation 3]}$$

$$v_g = \left(\frac{\partial\beta}{\partial w}\right)^{-1} = w^2\sqrt{L_L C_L} \quad \text{[Equation 4]}$$

In the case where the LH transmission line is implemented, a RH characteristic exists due to the voltage and current lost by the propagation of electromagnetic waves. Thus, there does not exist a pure LH transmission line and the LH transmission line can be equalized as a CRLH transmission line, that is, a combination of RH and LH. The CRLH transmission line is composed of N cells. Each cell must have an electrical length shorter than a designed frequency. This is called the effective homogeneity condition. Under this condition, an equivalent circuit of a unit cell of the CRLH transmission line is illustrated in FIG. 4. The propagation constant of an ideal CRLH transmission line with no loss is expressed by the following Equation 5 by Bloch:

$$\cos(\beta_{CRLH^d}) = \cos(\beta_{RH^d})\left(1 - \frac{1}{4\omega^2 L_{LH}C_{LH}}\right) + \sin(\beta_{RH^d})\left(\frac{1}{2\omega C_{LH}Z_0} + \frac{Z_0}{2\omega L_0}\right) - \frac{1}{4\omega^2 L_{LH}C_{LH}} \quad \text{[Equation 5]}$$

In the above Equation, $\beta_{CRLH}$, $_{RH}$ and $_{LH}$ denote the propagation constants of the CRLH transmission line, the RH transmission line and the LH transmission line. The unit cell of the CRLH transmission line has a very small electrical length ($d<\lambda_g/4$). The Equation 5 can be approximated into the following Equation 6:

$$\beta_{CRLH} \approx \pm\omega\sqrt{\left(L_{RH} - \frac{1}{\omega^2 C_{LH} d}\right)\left(C_{RH} - \frac{1}{\omega^2 L_{LH} d}\right)} \quad \text{[Equation 6]}$$

From the Equation 6, it can be seen that in the CRLH transmission line, the characteristic of the LH transmission line becomes important when it has a low frequency band or a very short length ($d \ll 1$) and the characteristic of the RH transmission line becomes important when it has a high frequency band or a very long length. In the above Equation, when the RH transmission line and the LH transmission line are matched $$\left(Z_0 = \sqrt{\frac{L_{RH}}{C_{RH}}} = \sqrt{\frac{L_{LH}}{C_{LH}}}\right)$$

the above Equation can be simplified into the following Equation 7:

$$\beta_{CRLH} = \omega\sqrt{L_{RH} C_{RH}} + \frac{-1}{\omega\sqrt{L_{LH} C_{LH} d}} \quad \text{[Equation 7]}$$

A change of the phase in the unit cell of the CRLH transmission line through the Equation 7 is expressed in the sum of the RH transmission line and the LH transmission line as in the following Equation 8:

$$\Delta\Phi_{CRLH} = -\beta_{RH} d + \beta_{LH} = \Delta\Phi_{RH} + \Delta\Phi_{LH} \quad \text{[Equation 8]}$$

FIG. 5 is a view showing a ring switch in accordance with an embodiment of the present invention.

Referring to FIG. 5, a ring switch 100 in accordance with the present invention includes a CRLH transmission line 110 of a Φ degree phase, a CRLH transmission line 120 of a (Φ-180) degree phase, and PIN diodes 130. The PIN diode 130 is an element, which has an excellent linearity and very small distortion and can be switched at high speed, and operates as a switch when a control current is applied thereto.

When the control current is applied to the ring switch 100, the PIN diodes 130 are short and signals applied through a terminal 1 have a 180 degree phase difference through the CRLH transmission line 110 of a Φ degree phase and the CRLH transmission line 120 of a (Φ-180) degree phase, so the signals are attenuated in a terminal 2. In a similar way, signals reflected from the terminal 2 due to mismatching are also attenuated in the terminal 1. Thus, the ring switch operates as a switch when a control current is applied thereto.

A general ring switch employs a 180 degree phase difference in a specific frequency. However, if a CRLH transmission line employing MM is used, miniaturization can be realized and a broad-band transmission line can be implemented by controlling the slope of a phase change depending on a specific phase and frequency.

More specifically, the present invention can provide a ring-shaped RF switch by employing the CRLH transmission lines 110, 120, which are designed to have phases of specific Φ degrees and (Φ-180) degrees (that is, a 180 degree phase difference as a broad band) by a designer instead of a RH transmission line having −90 degree and −270 degree phases of a ring resonator.

A transmission line, which has a constant phase of a broad band and can be miniaturized, cannot be implemented through a general RH transmission line, but can be implemented through a CRLH transmission line (that is, a combination of a LH transmission line and a RH transmission line). The transmission line can be implemented by controlling the slope of a phase, which is varied depending on a frequency, according to the design of the RH transmission line and the LH transmission line as shown in FIG. 6. A design Equation of the two transmission lines 110, 120 employing CRLH for having a constant phase difference is expressed in the following Equation 9:

$$\Phi_{CRLH1} = \Phi_{CRLH2} + \pi \quad \text{[Equation 9]}$$

$$\frac{\Delta\Phi_{CRLH1}}{\Delta\omega} = \frac{\Delta\Phi_{CRLH2}}{\Delta\omega}$$

$$Z_0 = \sqrt{\frac{L_{RH}}{C_{RH}}} = \sqrt{\frac{L_{LH}}{C_{LH}}}$$

The Equation 9 indicates that the two transmission lines have their slopes matched identically at a central frequency designed to have a 180 degree phase difference. Assuming that the CRLH transmission line is composed of N unit cells under the condition that the unit length of a designed cell, that is, "d" is λ/4 or less, the design Equation of the first transmission line 110 can be induced to the following Equation 10 on the basis of the Equation 8:

$$\Phi_{CRLH1} = N \cdot \left(\omega\sqrt{L_{RH1} C_{RH1}} \cdot d + \frac{-1}{\omega\sqrt{L_{LH1} C_{LH1}}}\right) = N \cdot (\Phi_{RH1}(\omega) + \Phi_{LH1}(\omega)) \quad \text{[Equation 10]}$$

$$Z_0 = \sqrt{\frac{L_{RH1}}{C_{RH1}}} = \sqrt{\frac{L_{LH1}}{C_{LH1}}}$$

The construction of the CRLH transmission line includes N cells having the characteristic of the CRLH transmission line as shown in FIG. 7. The respective cells have the same electromagnetic characteristic. Each cell has an electrical length p, which is smaller than ¼ of a designed center frequency wavelength. Each cell of the CRLH transmission line is constructed as shown in FIG. 4, and the CRLH transmission line employing the cell is designed to have a N*p phase.

If a designer substitutes the size and desired phase of one cell of a microstrip, and impedance and the number of cells into the Equation 10, it results in the following Equation 11. A LH transmission line equivalent circuit of each cell, constituting the first CRLH transmission line 110, can be found.

$$C_{LH1} = \frac{1}{\omega \cdot Z_0\left(\Phi_{RH1} - \frac{\Phi_{CRLH1}}{N}\right)}$$ [Equation 11]

$$L_{LH1} = \frac{Z_0}{\omega \cdot \left(\phi_{RH1} - \frac{\Phi_{CRLH1}}{N}\right)}$$

The ring switch employs attenuation caused by a 180 degree phase difference. If the CRLH transmission line is employed, the Equation 9 can be simplified into the following Equation 12:

$$\frac{\Delta\Phi_{CRLH-90°}}{\Delta\omega} = \frac{\Delta\Phi_{CRLH-(-90°)}}{\Delta\omega}$$ [Equation 12]

An Equation with respect to the second CRLH transmission line 120 can be induced through the following induction process from the Equations 8 and 12.

$$\sqrt{L_{RH1}C_{RH1}} + \frac{1}{\omega^2\sqrt{L_{LH1}C_{LH1}}} = \sqrt{L_{RH2}C_{RH2}} + \frac{1}{\omega^2\sqrt{L_{LH2}C_{LH2}}}$$ [Equation 13]

If the inductance of LH is simplified as capacitance, it leads to $$\frac{1}{C_{LH2}} - \frac{1}{C_{LH1}} = Z_0 \cdot \omega\left(\begin{matrix}\omega\sqrt{L_{RH1}C_{RH1}}\,d_1 - \\ \omega\sqrt{L_{RH2}C_{RH2}}\,d_2\end{matrix}\right) = Z_0 \cdot \omega(\Phi_{RH1}(\omega) - \Phi_{RH2}(\omega))$$ [Equation 14]

If the Equation 11 is substituted into the Equation 14, it leads to $$\begin{aligned}\Phi_{RH2}(w) &= \omega\sqrt{L_{RH2}C_{RH2}}\,d_2 \\ &= \omega\sqrt{L_{RH1}C_{RH1}}\,d_1 - \frac{1}{2}\left(\frac{\Phi_{CRLH1}}{N_1} - \frac{\Phi_{CRLH2}}{N_2}\right) \\ &= \Phi_{RH1}(w) - \frac{1}{2}\left(\frac{\Phi_{CRLH1}}{N} - \frac{\Phi_{CRLH2}}{N}\right)\end{aligned}$$ [Equation 15]

If one transmission line is designed through this Equation, an electrical length of a RH transmission line of another transmission line is decided. The LH transmission line of the second CRLH transmission line 120 can be found as follows by employing the same.

$$\Phi_{LH2}(\omega) = \frac{\Phi_{CRLH1}(\omega)}{N} - \Phi_{RH2}(\omega)$$ [Equation 16]

The capacitance and inductance of the LH transmission line can be found as follows by employing the above Equation 16.

$$C_{LH2} = \frac{1}{\omega \cdot Z_0\left(\Phi_{RH2}(\omega) - \frac{\Phi_{CRLH2}(\omega)}{N}\right)}$$ [Equation 17]

$$L_{LH2} = \frac{Z_0}{\omega \cdot \left(\Phi_{RH2}(\omega) - \frac{\Phi_{CRLH2}(\omega)}{N}\right)}$$

A ring-shaped RF switch, which has a broad-band characteristic and can also be miniaturized at a low frequency band by employing a CRLH transmission line having a 180 degree phase difference in a broad band, can be provided.

Although the specific embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An RF switch comprising:

a diode adapted to operate as a switch when a control current is applied thereto;

a first CRLH transmission line of a Φ degree phase, which provides one signal transfer path from a terminal 1 to a terminal 2 when the diode is shorted due to application of a control current; and a second CRLH transmission line of a Φ-180 degree phase, which has a 180 degree phase difference from that of the first CRLH transmission line and provides the other signal transfer path from the terminal 1 to the terminal 2, wherein the first CRLH transmission line and the second CRLH transmission line comprise N cells having the same electromagnetic characteristic with a CRLH transmission line characteristic, and wherein each of the cells has an electrical length p, which is smaller than ¼ of a wavelength of a designed center frequency.

2. The RF switch of claim 1, wherein the Φ degree of the first CRLH transmission line is adjusted by controlling capacitance and inductance values included in a transmission line.

3. The RF switch of claim 1, wherein the first CRLH transmission line and the second CRLH transmission line composed of the N cells satisfy the following Equations:

$$\Phi_{CRLH1} = N \cdot \left(\omega\sqrt{L_{RH1}C_{RH1}} \cdot d + \frac{-1}{\omega\sqrt{L_{LH1}C_{LH1}}}\right) = N \cdot (\Phi_{RH1}(\omega) + \Phi_{LH1}(\omega)),$$

and $$Z_O = \sqrt{\frac{L_{RH1}}{C_{RH1}}} = \sqrt{\frac{L_{LH1}}{C_{LH1}}}.$$

4. The RF switch of claim 1, wherein the diode includes a PIN diode, which has an excellent linearity and very small distortion and can be switched at high speed.

5. The RF switch of claim 1, wherein the first CRLH transmission line and the second CRLH transmission line satisfy the following Equations in order to satisfy a constant phase difference:

$$\Phi_{CRLH1} = \Phi_{CRLH2} + \pi$$

$$\frac{\Delta\Phi_{CRLH1}}{\Delta\omega} = \frac{\Delta\Phi_{CRLH2}}{\Delta\omega},$$

and $$Z_O = \sqrt{\frac{L_{RH}}{C_{RH}}} = \sqrt{\frac{L_{LH}}{C_{LH}}}.$$

6. A radio terminal comprising an RF switch comprising:

a diode adapted to operate as a switch when a control current is applied thereto;

a first CRLH transmission line of a Φ degree phase, which provides one signal transfer path from a terminal 1 to a terminal 2 when the diode is shorted due to application of a control current; and a second CRLH transmission line of a Φ-180 degree phase, which has a 180 degree phase difference from that of the first CRLH transmission line and provides the other signal transfer path from the terminal 1 to the terminal 2, wherein the first CRLH transmission line and the second CRLH transmission line comprise N cells having the same electromagnetic characteristic with a CRLH transmission line characteristic, and wherein each of the cells has an electrical length p, which is smaller than ¼ of a wavelength of a designed center frequency.

* * * * *